US010307325B1

(12) United States Patent
Johnson

(10) Patent No.: US 10,307,325 B1
(45) **Date of Patent: *Jun. 4, 2019**

(54) CYLINDRICAL CORE EXERCISE AND MASSAGE ROLLER

(71) Applicant: Ronald B. Johnson, Honokaa, HI (US)

(72) Inventor: Ronald B. Johnson, Honokaa, HI (US)

( * ) Notice: Subject to any disclaimer, the term of this patent is extended or adjusted under 35 U.S.C. 154(b) by 732 days.

This patent is subject to a terminal disclaimer.

(21) Appl. No.: 14/849,438

(22) Filed: Sep. 9, 2015

Related U.S. Application Data

(63) Continuation-in-part of application No. 12/802,551, filed on Jun. 8, 2010, now Pat. No. 9,668,933.

(51) Int. Cl.
*A61H 15/00* (2006.01)

(52) U.S. Cl.
CPC ..... *A61H 15/00* (2013.01); *A61H 15/0092* (2013.01); *A61H 2015/0007* (2013.01); *A61H 2015/0014* (2013.01); *A61H 2015/0021* (2013.01); *A61H 2201/1671* (2013.01)

(58) Field of Classification Search
CPC ..... A61H 15/00–02; A61H 2015/0007–0071; A61H 15/02; A61H 15/0092; A61H 15/0078; A61H 15/0085; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 2201/1683; A61H 2201/1671
USPC ..... 601/118–130; D24/211–212
See application file for complete search history.

(56) References Cited

U.S. PATENT DOCUMENTS

| | | | | |
|---|---|---|---|---|
| 655,490 | A * | 8/1900 | Hollem | A61H 7/003 601/135 |
| 1,726,560 | A | 9/1929 | Hassler | 601/136 |
| 1,811,764 | A | 6/1931 | Sherwood | |
| 2,273,710 | A | 2/1942 | Klaes | 601/119 |
| 2,286,324 | A | 6/1942 | Wentz | |
| 4,210,135 | A | 7/1980 | Deuser | |
| D256,841 | S | 9/1980 | Corbett et al. | |
| 4,345,387 | A | 8/1982 | Daswick | 36/43 |
| 4,378,007 | A | 3/1983 | Kachadourian | |
| D285,117 | S | 8/1986 | Snyder | |
| 4,846,159 | A | 7/1989 | Anzai | |

(Continued)

OTHER PUBLICATIONS

Printed Webpage, "File: Shore A vs Asker C Scales.png", Wikimedia Commons. Accessed Feb. 22, 2018.*

(Continued)

*Primary Examiner* — Colin W Stuart
(74) *Attorney, Agent, or Firm* — Booth Udall Fuller, PLC

(57) ABSTRACT

A roller which an individual may use to perform a variety of self-applied exercises for massage, myofascial release and other exercises. The roller is cylindrical having a resilient outer surface on which are a plurality of axially spaced, circumferentially extending bands of similar projections which manipulate the body of the individual when the individual rolls against the surface of the roller. The projections are equally circumferentially spaced in each band extending around the cylindrical body. The material and shape of the projections are selected to provide greater resistance to bending or flexing to forces applied axially than to tangentially applied forces.

20 Claims, 18 Drawing Sheets

(56) References Cited

U.S. PATENT DOCUMENTS

| | | | | |
|---|---|---|---|---|
| 4,907,355 | A | 3/1990 | Allen et al. | 36/131 |
| 4,945,900 | A | 8/1990 | Masuda | |
| 5,123,406 | A * | 6/1992 | Masuda | A61H 15/0092 601/120 |
| 5,143,056 | A * | 9/1992 | Yih-Jong | A61H 15/00 601/118 |
| D345,610 | S | 3/1994 | Shin | |
| D357,952 | S | 5/1995 | Chen | |
| 5,735,804 | A | 4/1998 | Chan | 601/136 |
| 5,824,013 | A | 10/1998 | Allen | 606/240 |
| 5,947,666 | A | 9/1999 | Huang | |
| 6,375,601 | B1 * | 4/2002 | Johnson | A61H 1/0292 297/452.13 |
| D471,636 | S | 3/2003 | Yu | |
| 6,764,456 | B1 * | 7/2004 | Doherty | A61H 15/00 601/118 |
| 7,007,978 | B1 | 3/2006 | Purdom | |
| 7,108,646 | B1 | 9/2006 | Quick | 482/148 |
| 7,918,774 | B2 | 4/2011 | Dye | 482/132 |
| 8,584,299 | B2 * | 11/2013 | Chan | A46B 15/00 15/110 |
| 9,668,933 | B1 * | 6/2017 | Johnson | A61H 15/00 |
| 2002/0103415 | A1 | 8/2002 | Manska | |
| 2005/0033205 | A1 | 2/2005 | Komkin | |
| 2005/0049532 | A1 | 3/2005 | Lee | |
| 2005/0131320 | A1 | 6/2005 | Lee | 601/119 |
| 2007/0072952 | A1 | 3/2007 | Kusakawa et al. | 521/134 |
| 2007/0129654 | A1 * | 6/2007 | Anderson, Jr. | A61H 15/00 601/119 |
| 2008/0090707 | A1 | 4/2008 | Dye | 482/132 |
| 2008/0103421 | A1 | 5/2008 | Nicholson | |
| 2009/0112137 | A1 | 4/2009 | Lamore | |
| 2009/0222994 | A1 * | 9/2009 | Wood | A61H 15/0092 5/655.9 |
| 2010/0049106 | A1 * | 2/2010 | Gueret | A45D 34/041 601/112 |
| 2011/0245741 | A1 | 10/2011 | L'Homme | |
| 2011/0313333 | A1 | 12/2011 | Nicholson | |
| 2012/0065557 | A1 * | 3/2012 | Phillips | A61H 15/0092 601/99 |

OTHER PUBLICATIONS

Muscleroll—Biowellnesssolutions.com—2008.
Power Systems 2009 Product Catalog—p. 73.

* cited by examiner (UPPER BACK)

(CALF)

CYLINDRICAL CORE EXERCISE AND MASSAGE ROLLER

This application is a continuation-in-part application of the earlier U.S. Utility Patent Application to Johnson entitled "Exercise and Massage Roller," application Ser. No. 12/802,551, filed Jun. 8, 2010, now pending, the disclosure of which is hereby incorporated herein by reference.

FIELD OF THE INVENTION

The present invention relates to an exercise and massage apparatus and more particularly relates to a roller which an individual may use to perform a wide variety of self-applied exercises for massage, myofascial release and other healthful benefits.

BACKGROUND OF THE INVENTION

Many athletes, trainers, therapists and others involved in fitness and training endorse the use of various types of massage devices and techniques to achieve myofascial relief, as well as other benefits. These benefits include improved balance, posture, reduction of chronic pain, improved flexibility, enhanced range of motion, as well as general well-being and alleviation of stress.

Fascia is a type of dense, connective tissue which surrounds muscles, bones, joints and other parts of the body. This tissue can become inflamed, thick, tough and knotted causing pain in areas termed "trigger points." Many therapists and trainers recommend the use of myofascial release massage to treat these trigger point areas, including self-applied massage exercises.

Traditionally there are various self-applied exercises that an individual can perform which do not require the presence or assistance of an attendant or masseuse. These exercises often involve the use of some type of device such as a simple roller. Rollers used for self-myofascial release and massage therapy will also help develop balance and alignment. These rollers are generally resilient rollers of materials such as rubber or heat-sealed EVA foams and are available in different lengths, diameters and surface textures. Conventional foam rollers will, to some extent, compress soft tissue. Using these rollers in various fashions, such as performing simple exercises in which the individual rolls the roller against a part of the user's body may improve blood flow and tissue flexibility. However, the effect is often limited and relatively superficial and these type rollers do not provide the deeper and thorough massage effect necessary to achieve effective myofascial release.

SUMMARY

Briefly, a self-massage and myofascial release roller which has an elongated cylindrical body which may be solid or may have a hollow core. The exterior surface of the roller is a natural or synthetic resilient material. Arranged on the exterior surface of the roller body and integrally formed therewith, are a plurality of axially spaced-apart, circumferentially extending bands of similarly shaped massage projections. The individual projections are equally circumferentially spaced in the band extending around the cylindrical body of the roller. The individual projections in the spaced-apart bands may be axially aligned or the bands may be alternately offset so the projections in alternate rows are axially aligned.

In an embodiment, each of the projections has a radial cross-section having a generally arcuate apex with opposite sidewalls and end walls diverging downwardly to transition into the cylindrical body. The projections each have an axial cross-section extending through the apex which is generally rectilinear. The projections are a material selected to provide greater resistance to bending or flexing to forces axially applied than to tangentially applied forces to provide selective massage effects with a variety of self-applied exercises.

In other embodiments, the massage projections may be variously configured to produce the desired resistance characteristics upon contact, pressure and direction of applied force.

The surface of the roller body and projections are smooth, non-porous to repel dirt and to facilitate cleaning. The material of the roller body and projections may also be formulated to include suitable antibacterial and antifungal compounds.

BRIEF DESCRIPTION OF THE DRAWINGS

The above and other advantages and objects of the present invention will become more apparent from the following description, claims and drawings in which:

DETAILED DESCRIPTION

This disclosure, its aspects and implementations, are not limited to the specific components or assembly procedures disclosed herein. Many additional components and assembly procedures known in the art consistent with the intended massage roller and/or assembly procedures for a massage roller will become apparent for use with implementations of massage rollers from this disclosure. Accordingly, for example, although massage rollers are disclosed, such massage rollers and implementing components may comprise any shape, size, style, type, model, version, measurement, concentration, material, quantity, and/or the like as is known in the art for such massage rollers and implementing components, consistent with the intended operation of a massage roller.

Turning now to the drawings, particularly FIGS. 1 through 7, a massage therapy and exercise roller according to the present is shown as generally designated by the numeral 10.

Figure 3:
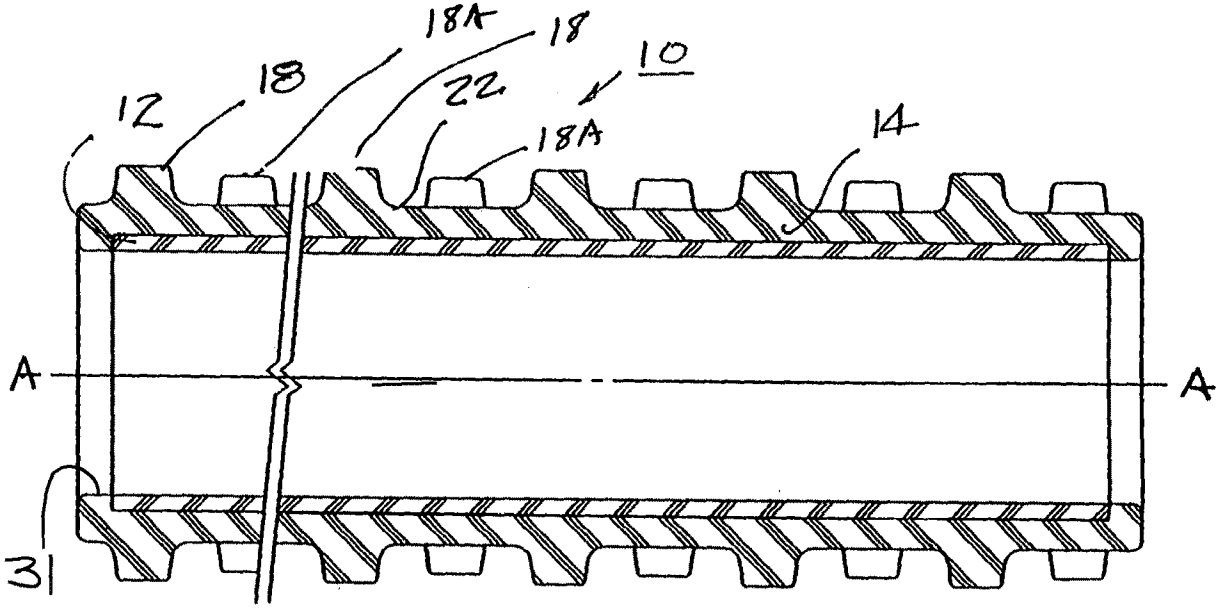
FIG. 3 is a longitudinal section view taken along line 3-3 of FIG. 2.
Figure 2:
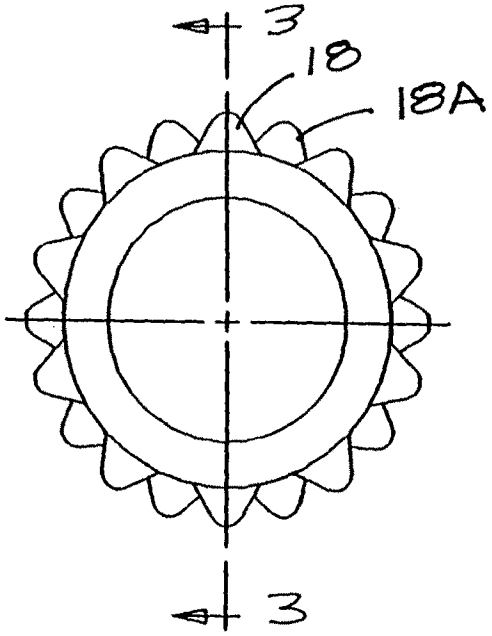
FIG. 2 is an end view thereof.
Figure 4:
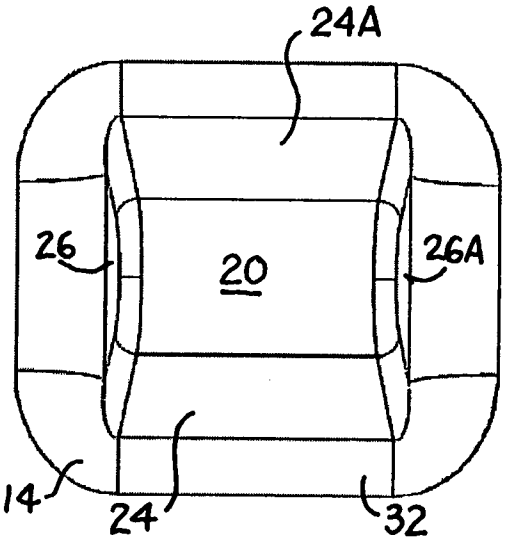
FIG. 4 is a top view of one of the projections on the surface of the roller shown in FIG. 1.
Figure 6:
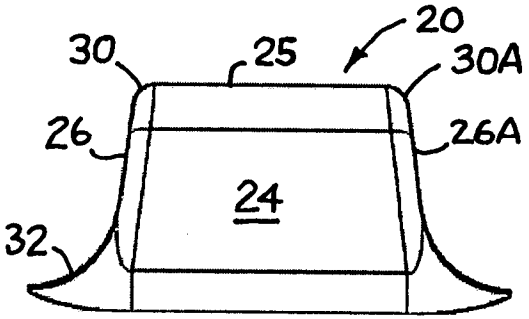
FIG. 6 is a side view of the projections, the opposite side view being the same.
Figure 5:
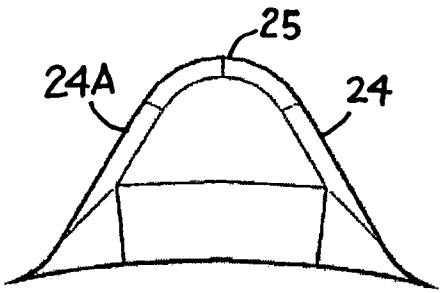
FIG. 5 is an end view of one of the projections, the opposite end being the same.

The roller 10 according to the present invention has a cylindrical core 12 which may be a suitable elastomeric material, rigid plastic, metal or wood. The roller core may be either solid or have a hollow construction, as shown in FIG. 3. A cylindrical exterior body 14 comprising two opposing lips 31 extends about the core. In one or more embodiments, two opposing lips 31 extend inward towards the axis of the roller 10 to interface and/or engage opposing ends of the core 12 between the two opposing lips 31. Accordingly, the two opposing lips 31 physically entrap the core 12 within the body 14, thus eliminating adhesive bonding or overmolding processes utilized in conventional apparatuses. According to some aspects, the hollow core comprises high-density polyethylene (HDPE). HDPE is advantageous to conventional cores comprised of polyvinyl chloride (PVC) or acrylonitrile butadiene styrene (ABS) because PVC and ABS are relatively brittle plastics, resulting in cracking and breaking cores responsive to high load or long term fatigue stresses. HDPE solves this problem because it has a lower tensile strength but greater toughness. This allows an HDPE hollow core 12 to flex rather than crack under a load.

The body 14 is preferably molded from an elastomeric material such as natural or synthetic rubber, which will provide the required stiffness, compressability, cleanability and surface texture. Exemplary materials are Neoprene®, Buna-N, silicone, polyurethane, EPDM, SBR, vinyl, butyl or synthetic foams such as polyethylene, EVA and polyolefins. A preferred material is a blend of EVA and a polyolefin with a solid EVA core both having a durometer hardness of between 30 to 50 Asker C. More particularly, a body 14 may comprise a blend of EVA and polyolefin having a hardness of between 40 and 50 Asker C. In other embodiments, a body may comprise a blend of EVA and polyolefin having a hardness of between about 40 and about 60 Asker C. In more particular embodiments, the body 14 comprises a blend of EVA and polyolefin having a durometer hardness of 44 Asker C. In other embodiments, the body comprises a blend of EVA and polyolefin having a durometer hardness of 60 Asker C. The size of the roller 10 may vary, but typically for most applications is approximately 4" to 6" in diameter and 12" to 36" in length.

Figure 1:
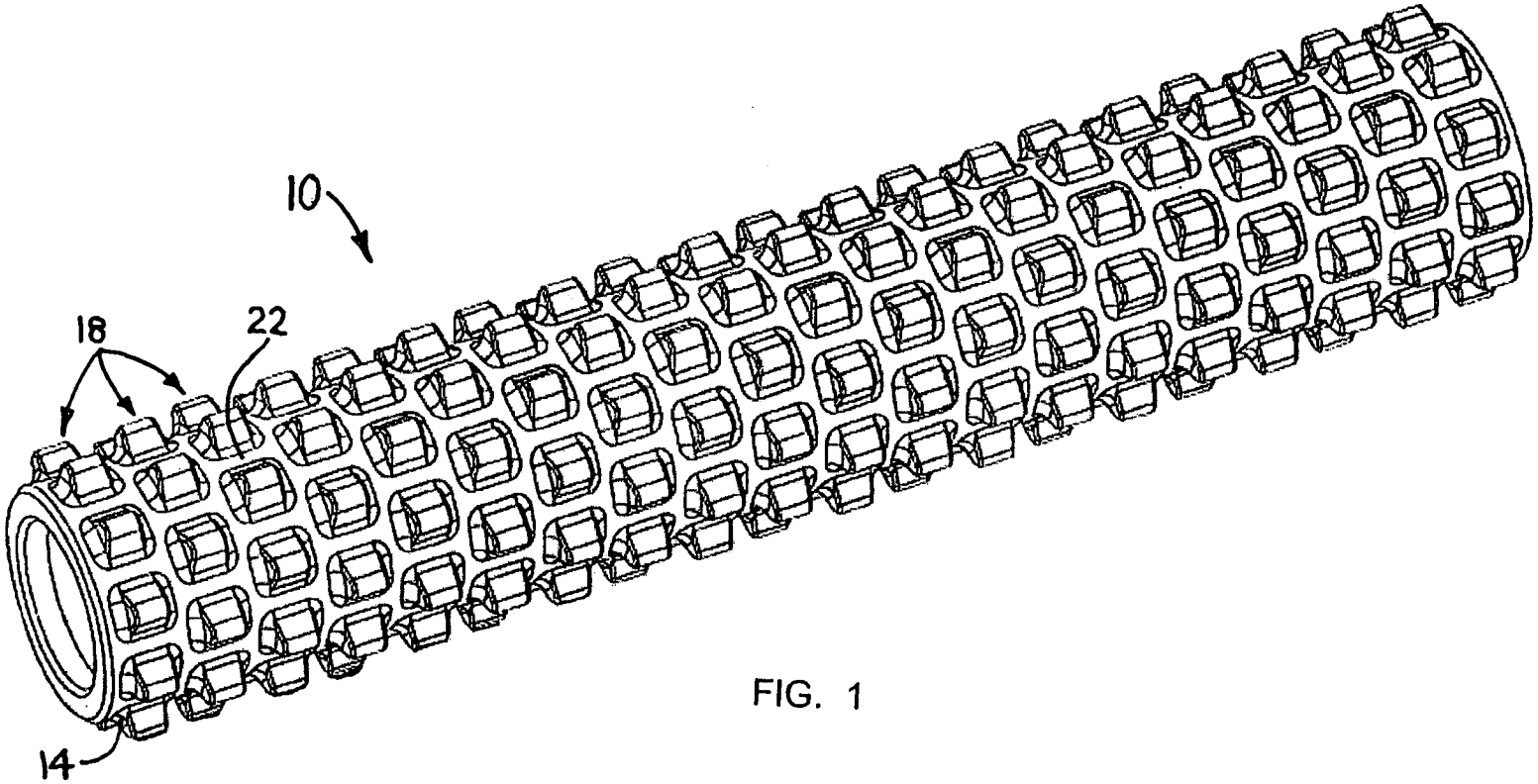
FIG. 1 is a perspective view of an embodiment of the exercise and massage roller of the present invention.

Integrally formed along the exterior surface of the body 14 are a plurality of axially spaced-apart, circumferential bands 18 of massage projections 20. The projections are similar in shape and are equally circumferentially spaced apart in each circular band 18. The circular bands of projections may be formed with the projections 20 axially aligned, or alternate bands may be staggered as shown in FIG. 1. Bands 18 are aligned and bands 18A are aligned with one another. In the staggered positions, the projections 20 in alternate rows are aligned and are also aligned with the intermediate space 22 existing between projections 20 in the adjacent rows. The particular orientation of the roller projections selected will be dependent upon personal preference, the exercises to be performed, as well as more subjective considerations such as tactile feel and comfort to the individual user. In some embodiments, a massage roller comprises twenty bands 18 each comprising ten projections 20. In other embodiments, a massage roller comprises fourteen bands 18 each comprising nine projections 20. In still other embodiments, a massage roller comprises eight bands 18 each comprising eight projections 20.

The details of the individual projections are best seen in FIGS. 4 to 7. Each projection 20 has opposite sidewalls 24, 24A which converge upwardly at an angle of approximately 15° to a generously radiused arcuate apex 25. The opposite end walls 26 and 26A diverge downwardly at an angle of approximately 60°. A slight radius extends along the upper edges 30, 30A of end walls 26 and 26A where the end walls transition into the sidewalls and also to the apex 25. The bottom edges of the integral sidewalls and end walls smoothly transition into the roller body 14 at radiused peripheral edge 32 extending around the base 29 of each projection.

Figure 7:
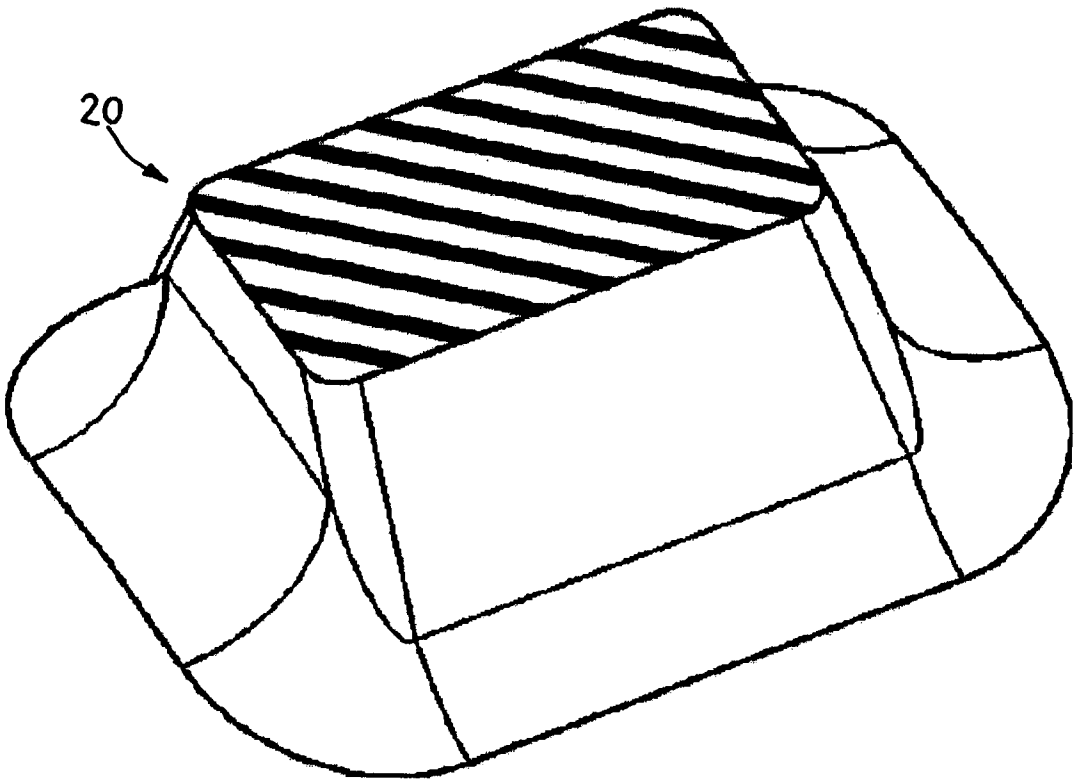
FIG. 7 is a perspective view of a representative projection on the roller partly cut-away.

The particular dimensions of the individual projections may vary, but it is preferred that the individual projections are each about ½" high, ¾" to 1½" in axial length and ½" to 1¼" wide at their bases. The shape and configuration of the projections is critical to achieving the self-massage benefits of the present invention. Contact with an external body, such as the body of a person performing exercises and other routines on the roller 10, results in application of forces tangential to the projections in both radial and axial directions. As a result, a bending movement is applied about the projections relative to their attachment at their bases to the cylindrical body 14. Because the projections 20 are non-circular in cross-section, as seen in FIG. 7, reaction to applied forces vary depending on the direction in which the force is applied.

In general, the initial and subsequent contact areas which are applied to the projections are related to the shape of the projections as the roller is rolled against the body of the user. The material and geometry of the projections affects the area of the contact, the size of the contact area under compressive load and the amount of bending of the projection.

An important functional feature is the configuration of the projections which are designed to respond differently to loads applied by the user's body in different directions to achieve the massage effect. Tangential application of force or load occurs when the overall motion of the body of the user is generally tangential to the roller 10 in a direction perpendicular to the roller axis A-A causing the roller to roll beneath the user. When a load or force is applied in an axial direction, the overall motion of the user is generally parallel to the axis A-A of the roller. Various representative exercises in which both tangential and axial application of loads are described below with reference to FIGS. 14 to 17.

Figure 8:
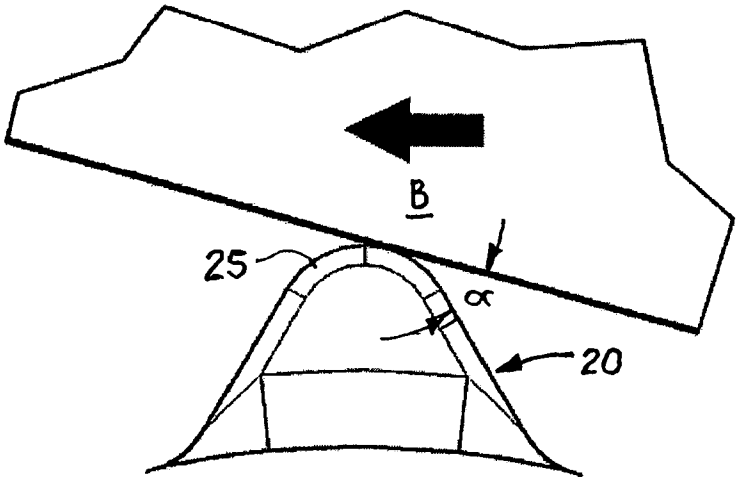
FIG. 8 is an end view of one of the projections, as seen in FIG. 1, shown with the application of a tangential load.

FIG. 8 shows the application of a tangential load to a projection 20 by the body of the user. The body of the user is represented by the letter "B" and a tangential force applied is indicated by the direction of the arrow which is tangential to the projections 20. The apices of the projections are fully radiused at 25 so the angle of contact (alpha) between the surface of the projection and the external body B remains tangential as the applied force engages a projection and then advances to the next projection as rotation of the roller occurs.

Figure 9:
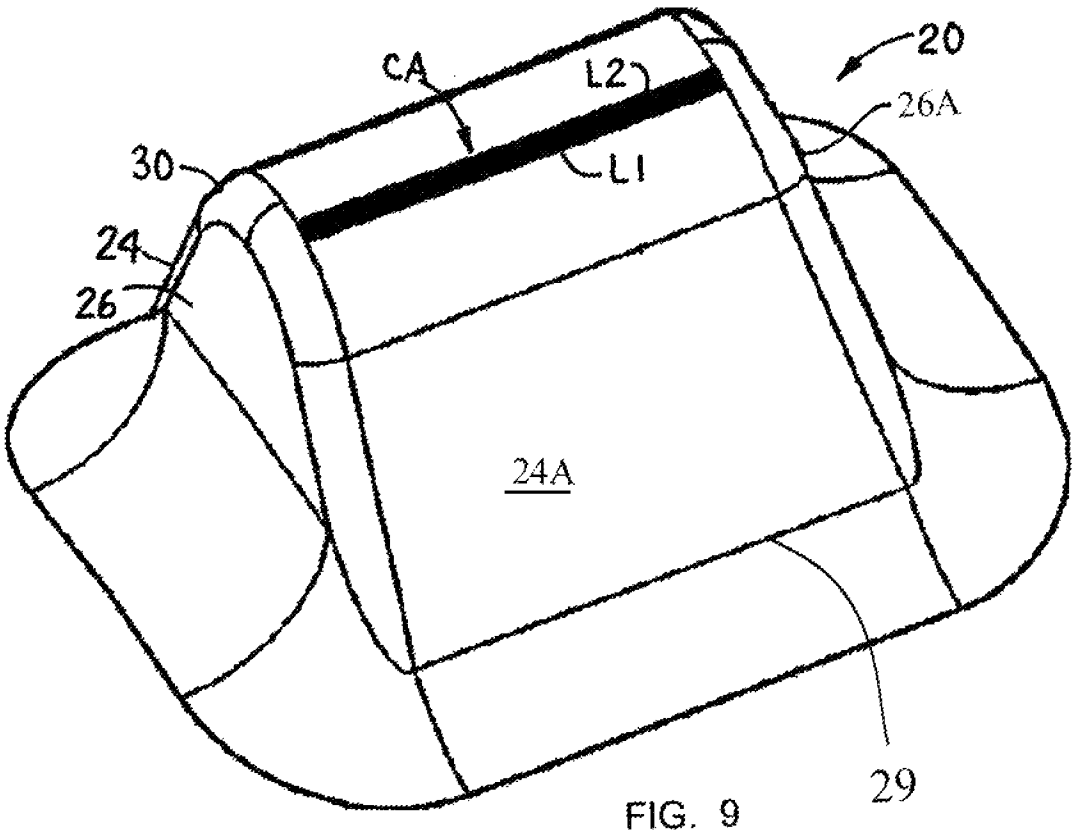
FIG. 9 is a perspective view showing the contact area as an initial tangential load is applied to a projection, as shown in FIG. 8.
Figure 10:
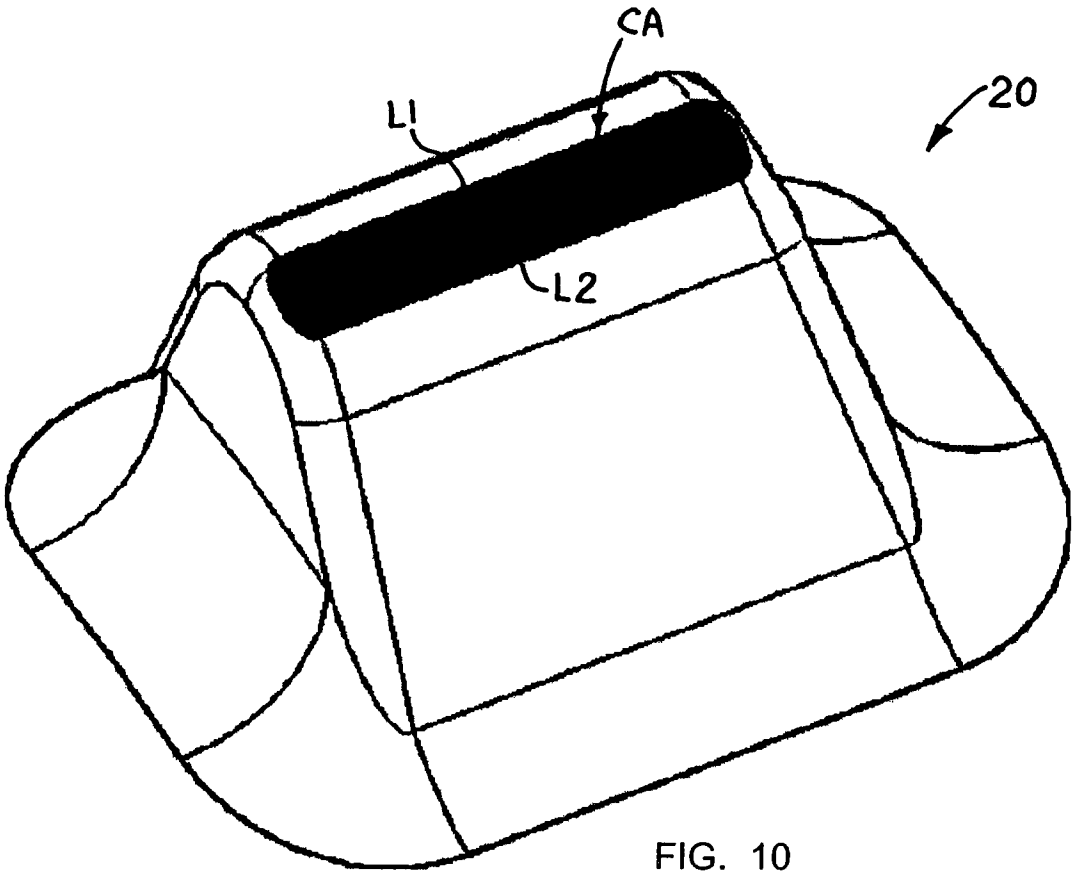
FIG. 10 is a perspective view similar to FIG. 9 showing increased contact area as the load applied to a projection is increased.

Referring to FIG. 9, the initial contact area CA when tangential forces are applied is bordered by two axial lines $L_1$, $L_2$, each extending the length of the projection. As the user's body B moves in the direction of the arrow, as seen in FIG. 8, the roller will roll and the contact area CA will enlarge as seen in FIG. 10.

As motion continues, the contact area CA between the user's body and the projection will gradually decrease and finally dissipate as the roller 10 continues to rotate and the body B moves to engage successive projections in the circular band.

The projection 20 responds in the manner of a cantilever beam. The deflection is proportionate to the beam's moment of inertia which is dependent on its cross-sectional shape. The cross-sectional shape of the projection is generally rectangular and the corresponding moment of inertia and resulting deflection is therefore proportionate to the width of the cross-sectional area times the cube of the height of the cross-sectional area.

The sidewalls 24, 24A of the projections have a more pronounced upwardly extending inward slope than the end walls 26, 26A. As a result, the angle of incidence between the plane of the contacting body B and the projection surface is less than it is when a load is applied in the axial direction.

Figure 11:
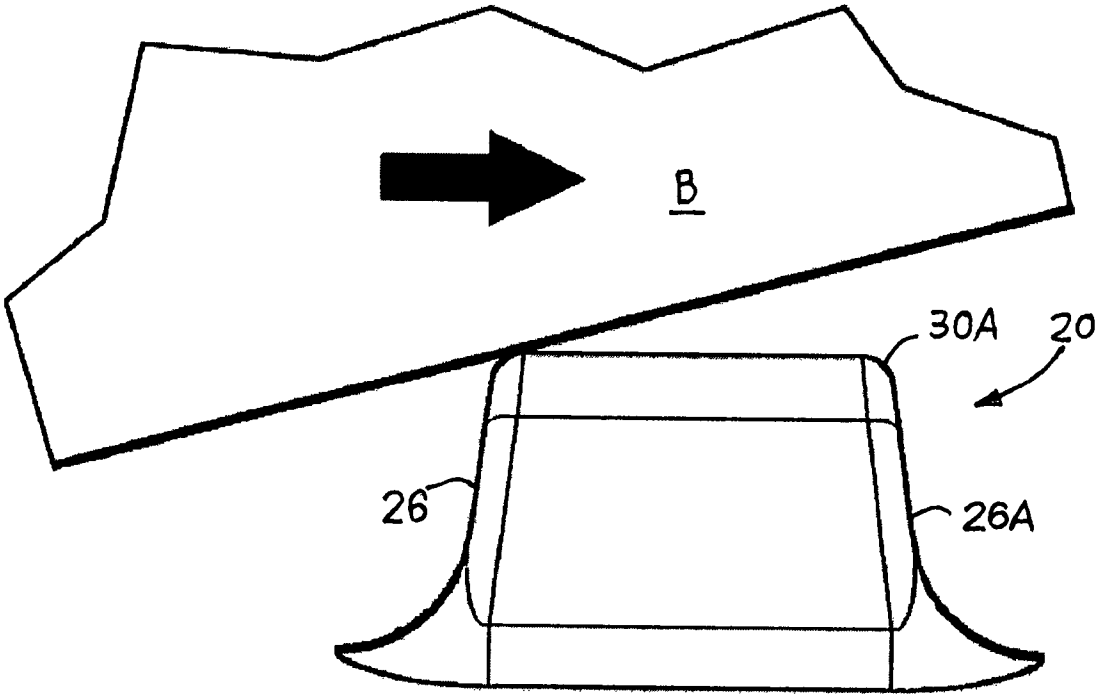
FIG. 11 is a side view of one of the projections, as seen in FIG. 1, showing an axial load being applied to the upper edge of a projection as would occur when some exercises are performed.
Figure 12:
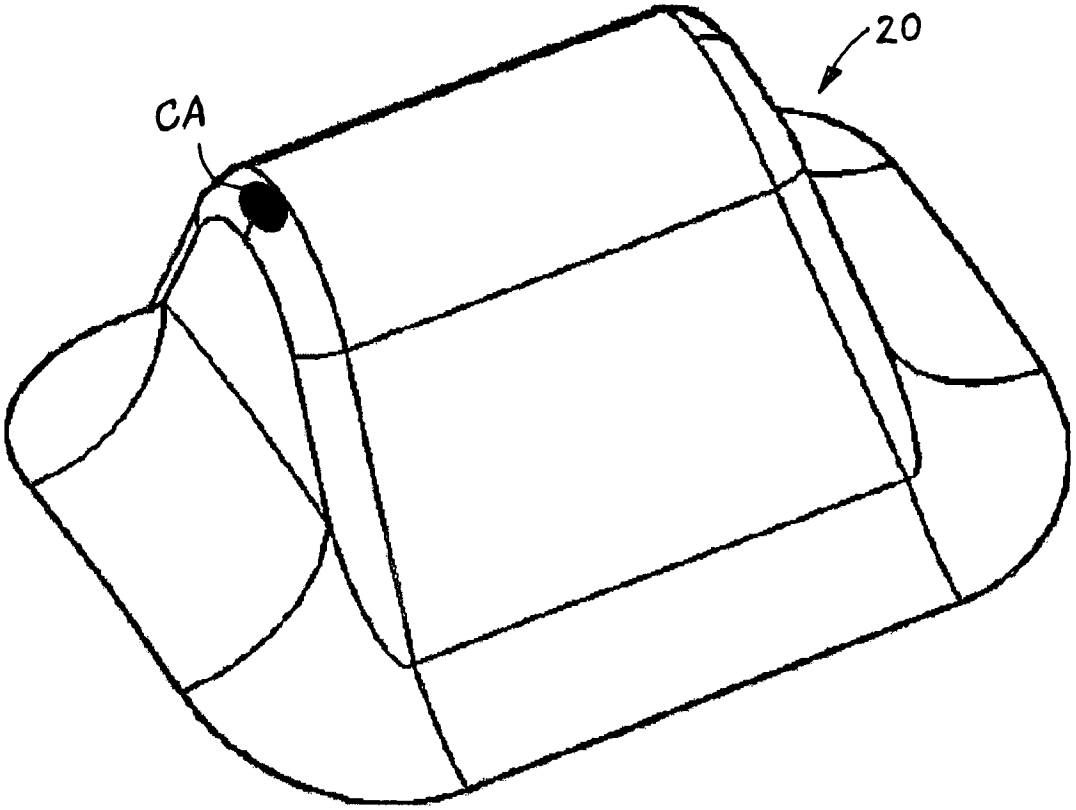
FIG. 12 is a perspective view showing the area of contact as an axial load is initially applied to a projection, as seen in FIG. 11.
Figure 13:
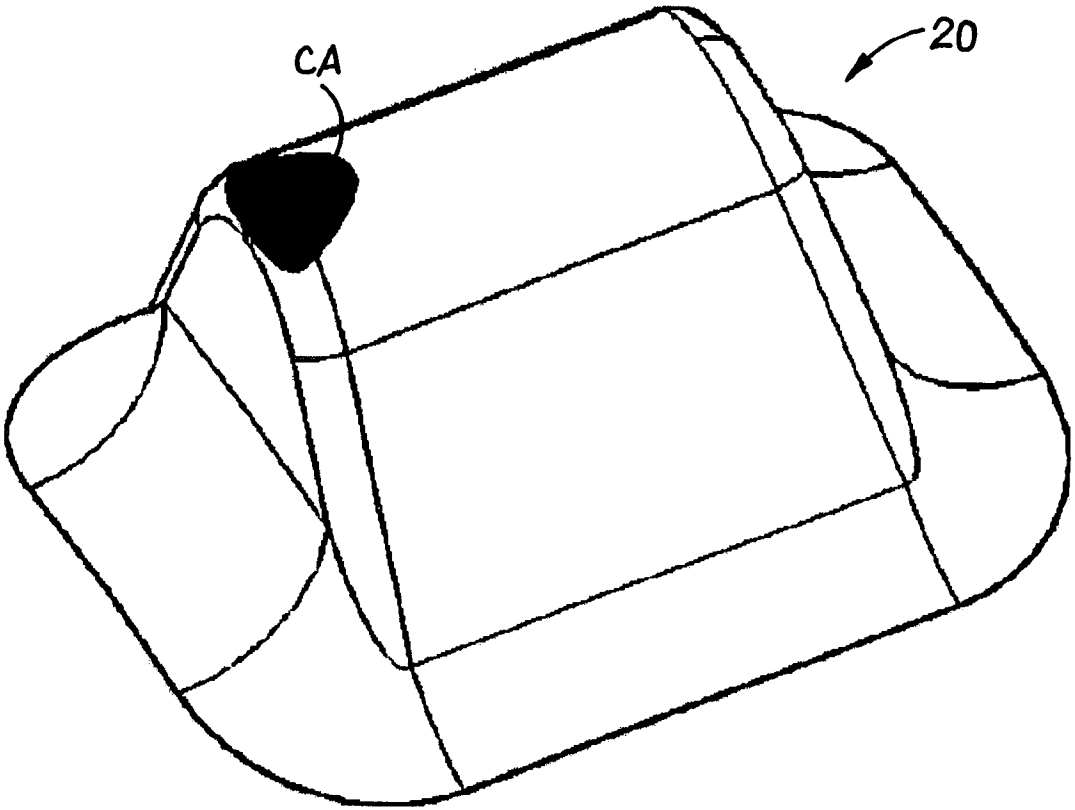
FIG. 13 is a perspective view of a projection showing the increased area of contact as a load is continued to be applied, as shown in FIG. 11.

Reference is now made to FIGS. 11 to 13 which show the response of a projection 20 to loads in the axial direction, applied during an exercise routine. Note the upper ends of the opposite end walls 26, 26A, each have a relatively small radii 30, 30A at their upper ends that transitions into the apex 25 and the sidewall areas. The initial contact with the plane of the body B is point contact, as seen in FIG. 12 represented by the area CA. This area enlarges to a generally circular contact area, as seen in FIG. 13, as the applied load increases and moves in a tangential direction with the resistance to flex being greater than with radial loads and higher contact pressure simulating deep application of massage by use of the thumbs and fingers.

FIGS. 11, 12 and 13 show the reaction to axial loads applied to a single projection. It will be appreciated that in normal use, multiple bands of projections will be engaged and then relieved of loads as the roller rotates against and moves along the body of the user, which is illustrated in FIG. 11.

Figure 14:
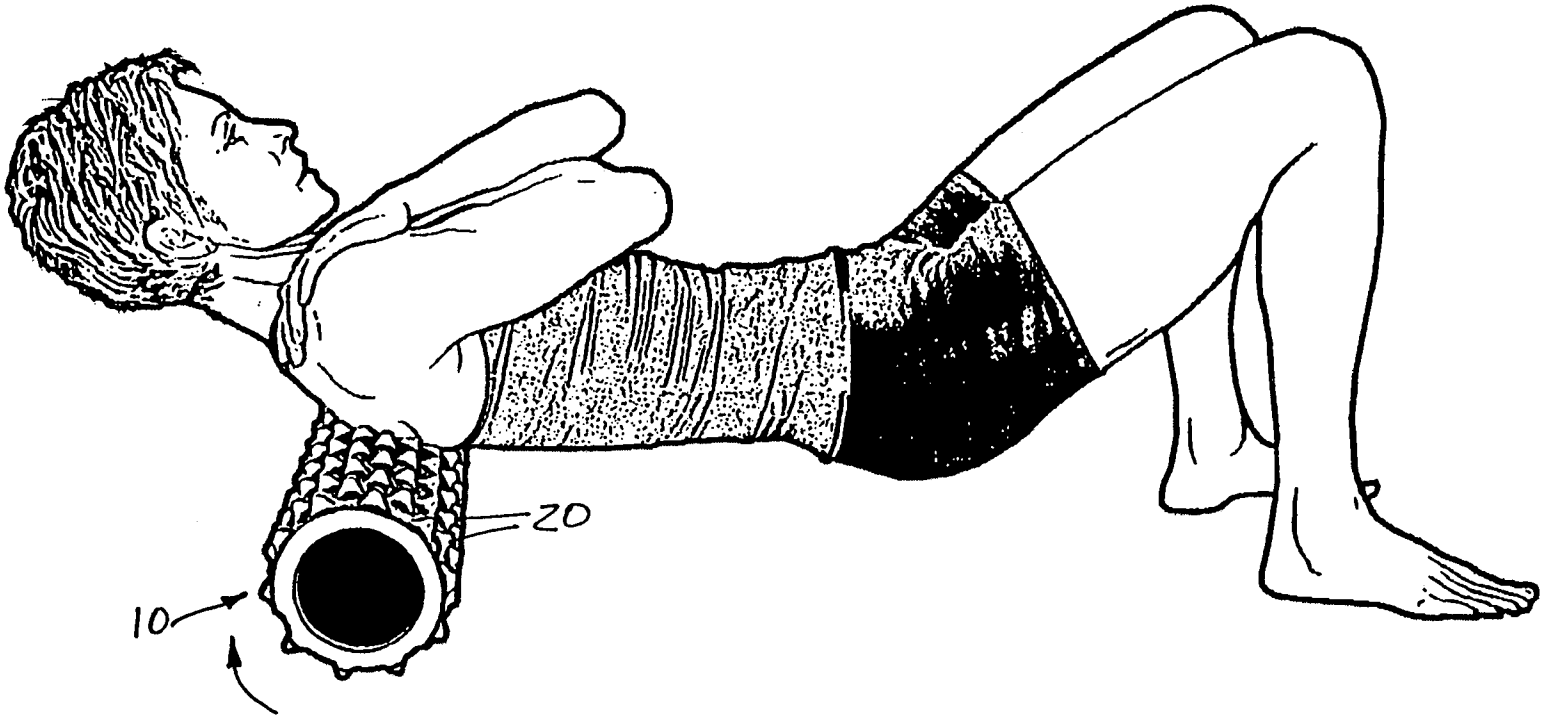
FIGS. 14 to 17 show various representative exercises that may be performed using a roller contemplated in this disclosure.
Figure 15:
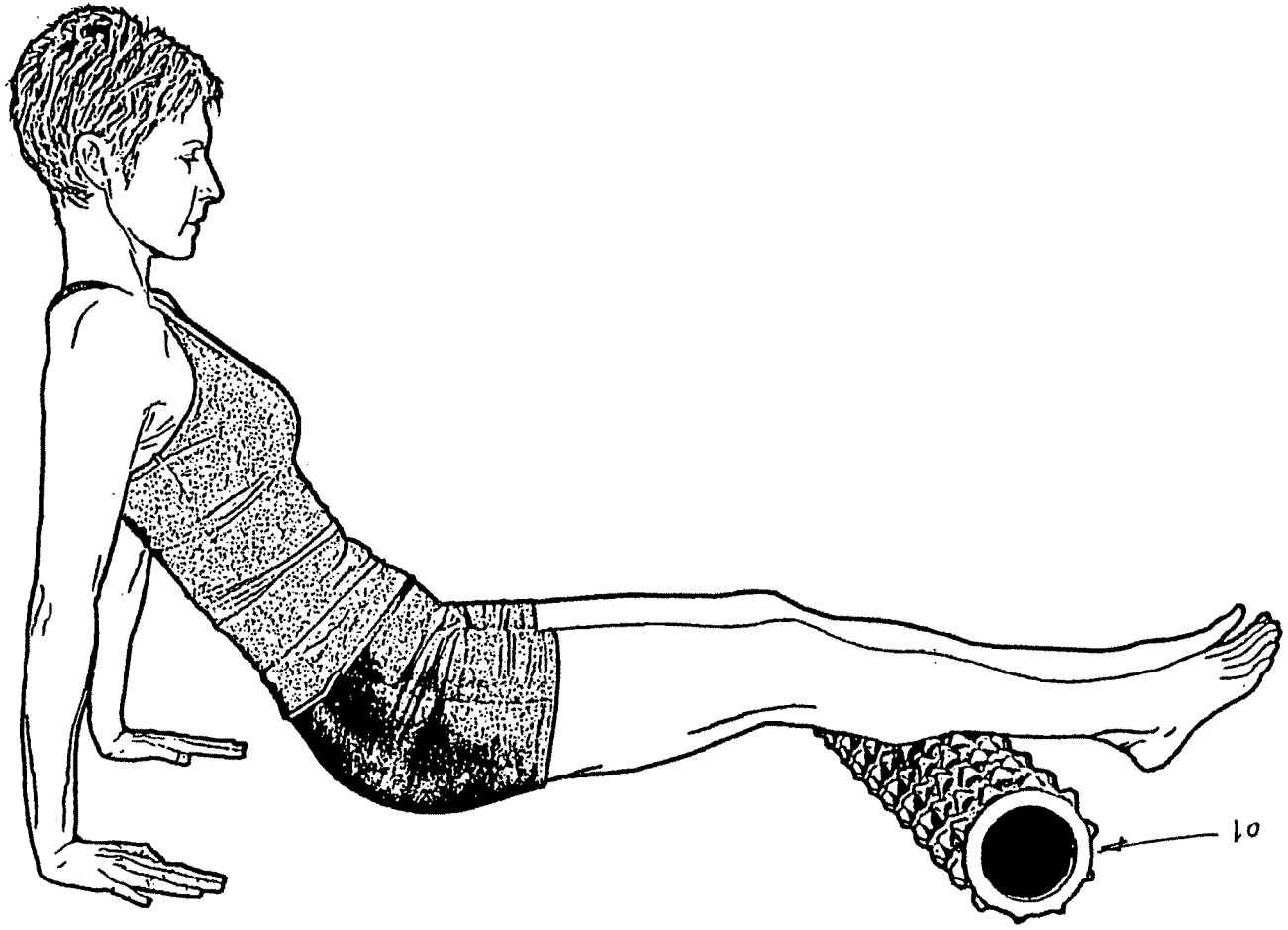
Figure 16:
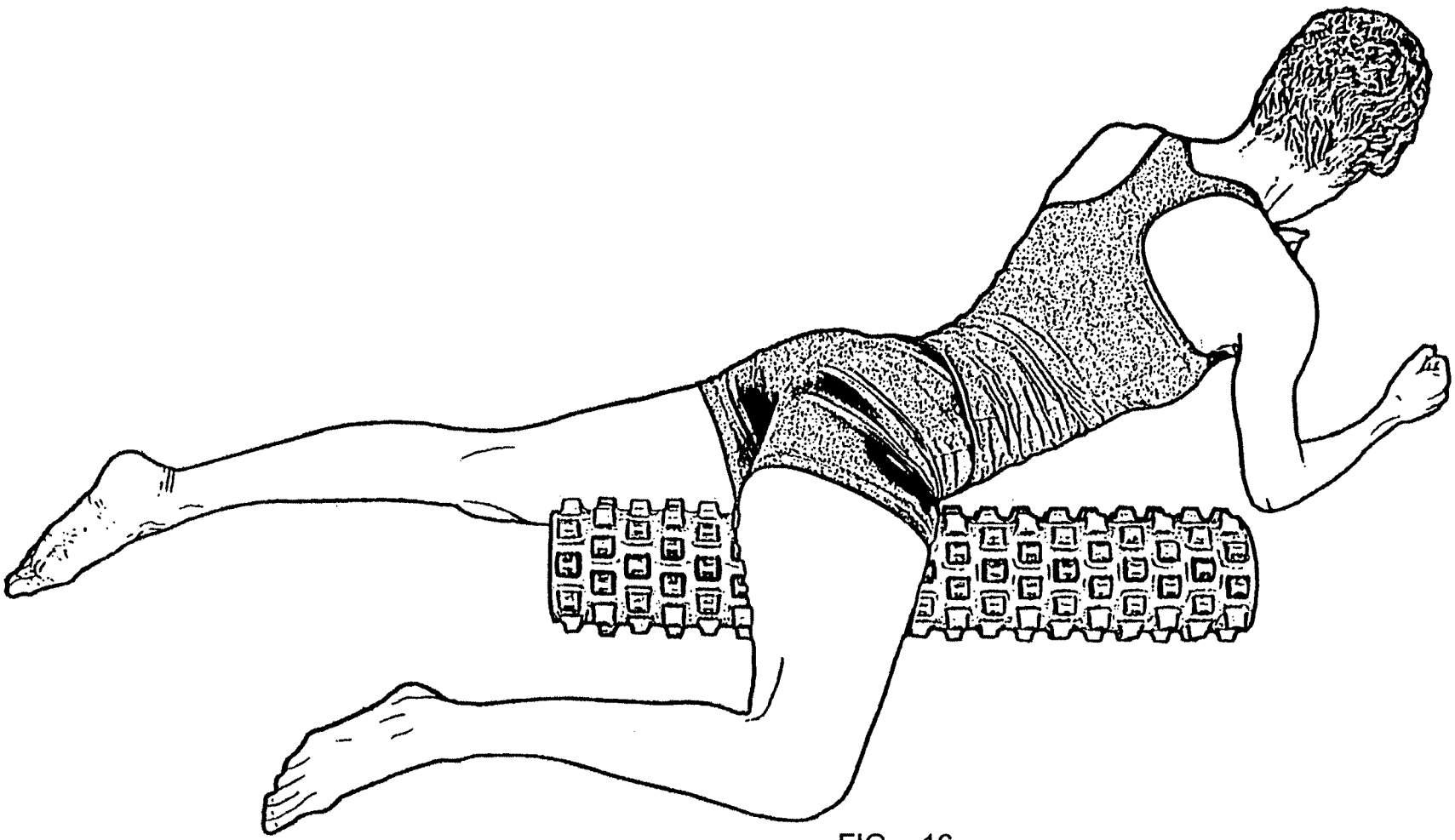

FIGS. 14 to 16 show several representative exercises that may be performed using the roller of the present invention. The various movements are broadly termed "exercises" but it is to be understood that they are self performed routines to achieve a number of beneficial results including myofascial release, therapy, massage, relaxation and other benefits. The exercises shown are only representative as the roller 10 may be used for numerous other exercises including, but not limited to, myofascial release.

Referring to FIG. 14, a representative upper back exercise is shown using the roller 10. The user is positioned facing upwardly having her upper back and shoulder area positioned against the roller 10 which is generally transverse to the body of the user. The user maintains her abdominal muscles flexed with her head and neck in a neutral position. The user will proceed to slowly roll the roller in the direction of the arrow causing the roller rotation to move from the lower thoracic area to the top of the upper thoracic area. Care should be taken to not roll excessively onto the neck area. To increase the intensity of the exercise, the user may place her arms across her chest and rock to the right and left as rolling movement occurs.

In FIG. 15, the user is shown exercising her calf muscles from the area just below her knees to just above her ankles. The user is shown sitting with her calves on the top of the roller 10 and her heels slightly off the floor. The intensity of the exercise can be increased by crossing one leg over the other at the ankles while continuing to roll the roller 10. For greater intensity, one leg may be placed on top of the roller and then the leg rocked to the left then to the right for deeper penetration by the projections.

FIG. 16 shows an exercise for the adductor muscles. The user is positioned face down supported on her elbows and forearms, keeping her abdominal and back muscles slightly flexed to stabilize her spine. The right knee is on the floor and the groin area of the left leg is against the top of the roller. The user will roll back and forth along the adductor muscles by slowly moving her hips to the left and right. Care should be taken to not apply excessive pressure to the adductor complex origin at the pelvis.

Figure 17:
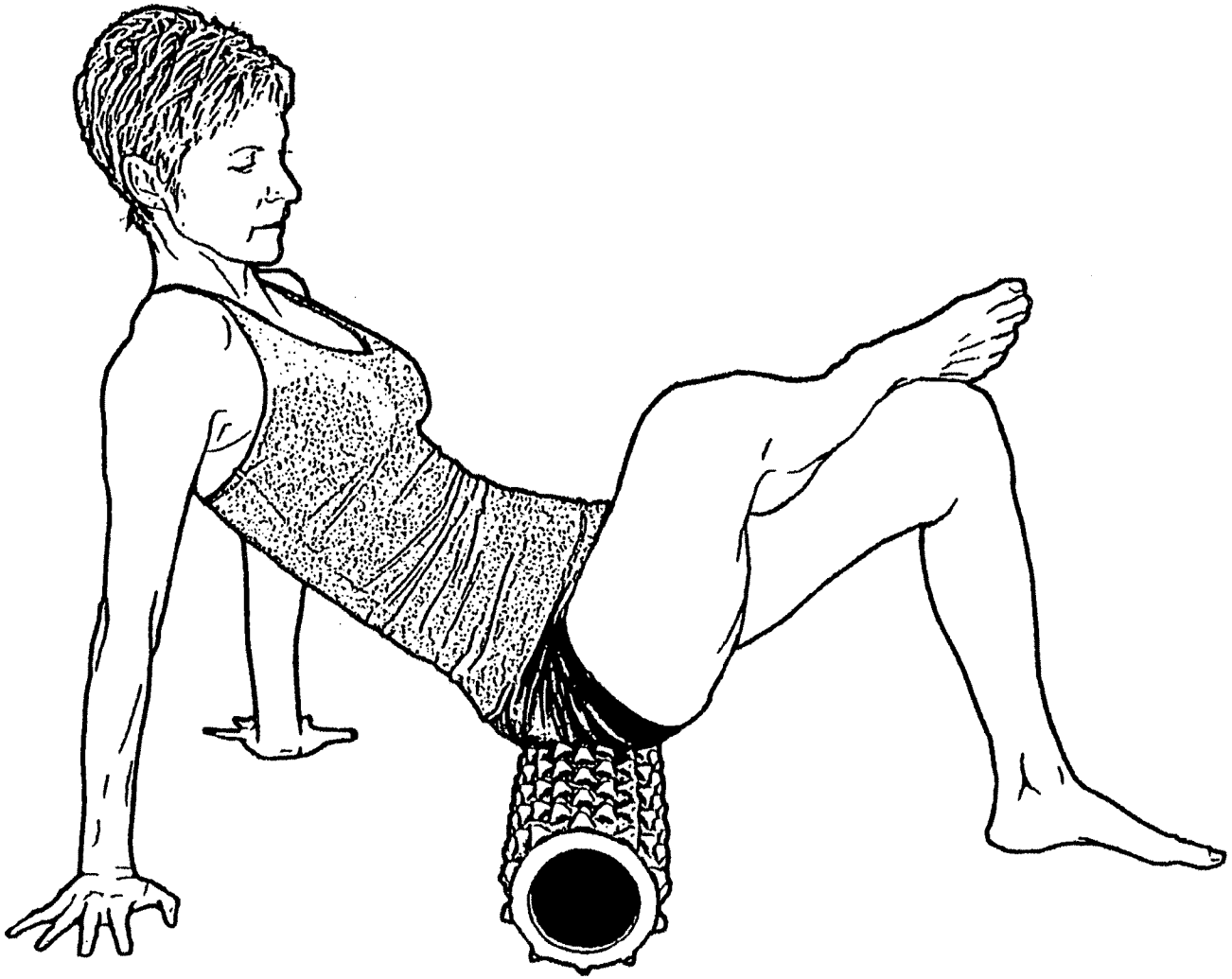

FIG. 17 illustrates another exercise primarily for the gluteal muscles.

The surface of the roller 10 contains a large number of specially arranged projections 20, as described, which are firm but flexible and simulate, to some extent, the thumbs of a massage therapist. As the roller 10 moves or rolls, the projections continuously knead the contours of the body, stretching soft tissue in several directions. The material of the roller and the projections is selected so that the projections are firmer than muscle, but softer than bones so they deflect properly.

The design of the roller 10 allows the user to control the pressure the projections apply to the individual which performs self-massage. The projections are closely spaced-apart, preferably less than 2", so that when performing the various exercises, several of the projections will simultaneously contact the individual's body. With a slight shift of the body, the individual can reduce the area of contact which increases pressure and provides a more deeply penetrating massage action.

The projections 20, as described above in FIGS. 1 to 7, each have a horizontal cross-section as seen in FIG. 7. Accordingly, projections of this shape and of a homogenous elastomeric material have the flex characteristics described above in which the resistance to flex to loads applied in the axial direction is greater than to tangential loads applied. This results in an exercise and massage roller which provides the user a greater range of available exercises and the ability to manage applications at varying levels of intensity. Because the roller projections have a shape which is selected to flex more in one direction, the more common exercises are performed with the roller rolling beneath the body of the user, the projections apply a "wiping" type of massage pressure. If the user "rocks" from side to side toward the ends of the roller 10, as described with reference to FIG. 15, the projections are more resistant to flex, creating a deeper massage effect.

Because the projections are inherently designed to have increased resistance to flex in the axial direction, a projection of a homogenous material in the shape of a cone or cylinder would not provide the required non-symmetrical flexion. However, other shapes such as oval or rectangular would be suitable.

Figure 18:
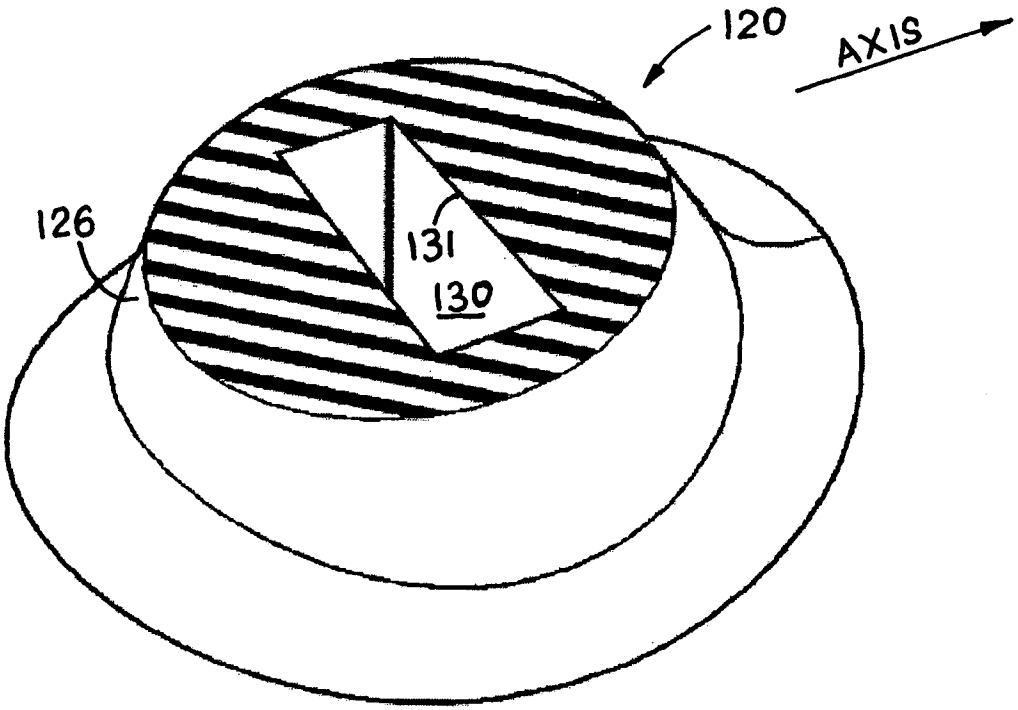
FIG. 18 is a perspective view showing yet another embodiment of a projection on the exercise roller in which an internal area of the projection is relieved to provide the desired bending characteristics.

However, projections of other shapes, such as conical projections, would also be suitable if designed to provide the desired flexure. FIG. 18 shows a cross-section of a conical projection 120 having a body with upwardly converging conical side wall 126 which is truncated at the upper end, not shown. In order to provide the desired flexure characteristics, the projection 120 is fabricated from a homogenous uniform elastomeric material as set forth above, but a section of the interior of the body is relieved at 130. The relieved area is shown as a generally rectangular cutout 130 centrally extending within the body. The cutout is oriented so the longer sidewalls 131 are generally perpendicular to the axis A-A of the roller. The projections 120 are integrally formed as part of the roller and are spaced in bands and rows as previously described. The cutout 130 will alter the symmetry of the shape establishing increased resistance to flex in the axial direction providing the desired characteristics.

Figure 19:
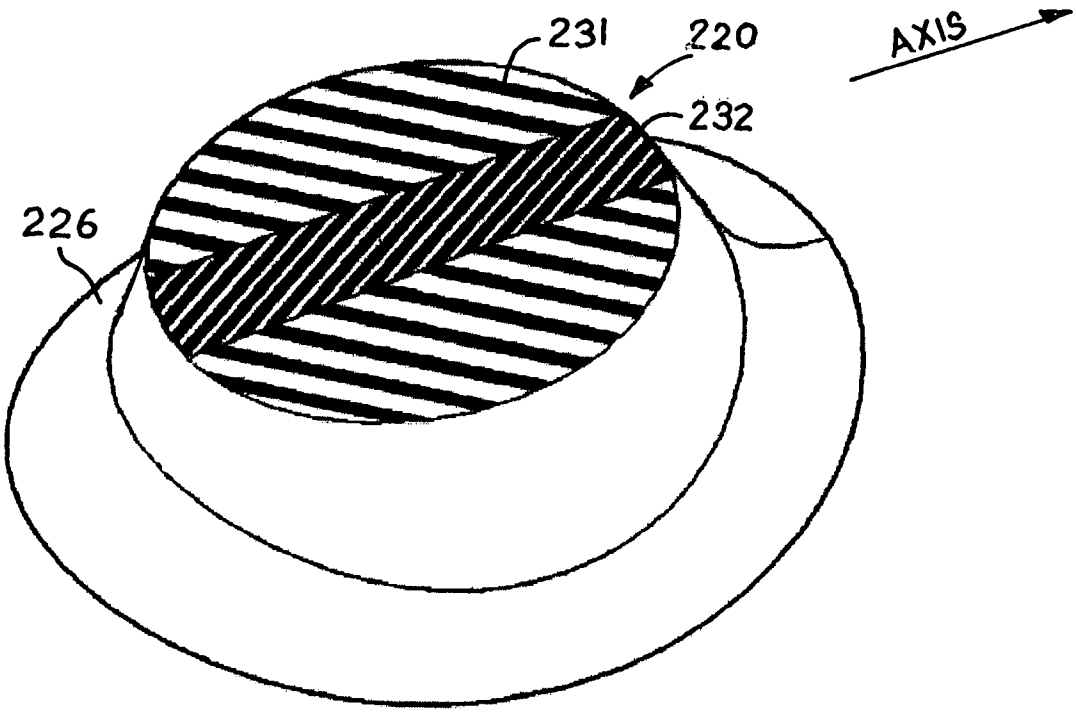
FIG. 19 is yet another perspective view partly broken away showing another embodiment for configuration of the projections extending from the surface of the roller in which the projections are fabricated from several materials having different characteristics.

In FIG. 19 another embodiment of a generally conical projection 220 is shown. The projection 220 has a base with a conical body 226 which extends from the roller body upwardly to a truncated apex, not shown. The material of the body 231 is a different elastomer than that of the insert 232. The insert 132 is a section that extends diametrically within the body and the projection is oriented on the body of the roller to provide greater resistance to flexure to axial loads, as opposed to radial loads. The projections 220 are oriented so the insert 132 is generally parallel to the axis A-A of the roller. These projections 220 are in spaced-apart bands about the roller and arranged in rows, as previously described. The projections are oriented to provide the greatest resistance to flex in the axial direction.

Figure 20:
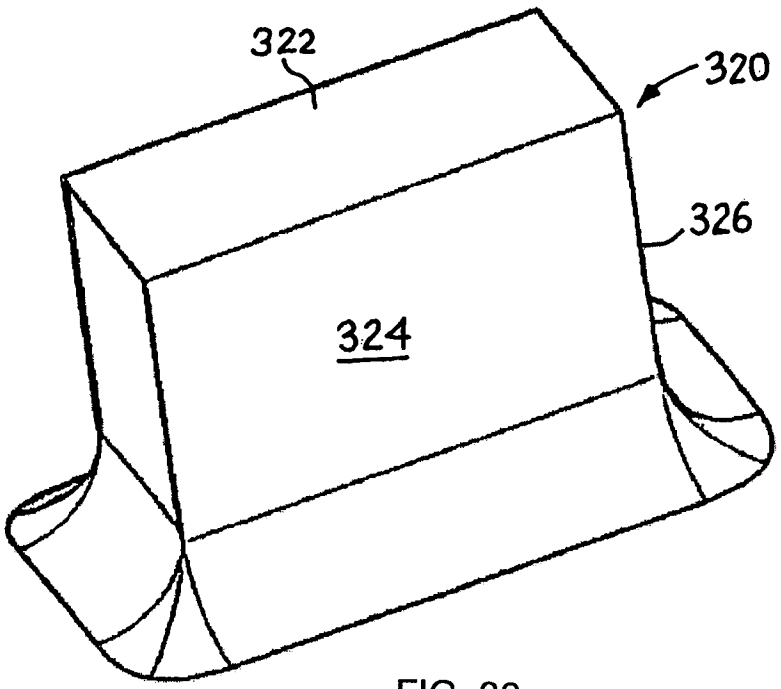
FIGS. 20 and 21 illustrate alternate shapes for the massage projections.
Figure 21:
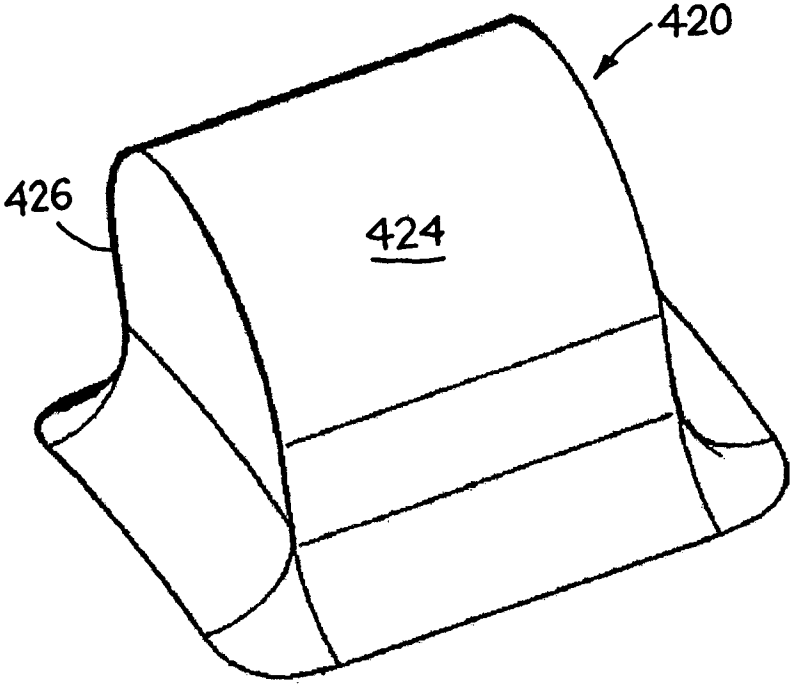

In FIGS. 20 and 21, alternate shapes for the projections are shown generally conforming to that shown in FIGS. 1 to 7. In FIG. 20, the projection 320 is generally rectilinear having top 322, sidewalls 324 and end walls 326 which transition into the body at their lower ends. In FIG. 21, the projection 420 generally has semi-parabolic end walls 426 and a continuously curved sidewall 424.

It will be obvious to those skilled in the art to make various changes, alterations and modifications to the invention described herein. To the extent such changes, alterations and modifications do not depart from the spirit and scope of the appended claims, they are intended to be encompassed therein.

The invention claimed is:

1. A massage roller, comprising:

a hollow cylindrical body comprising an axis, a hollow space within the hollow cylindrical body, an interior surface, and an exterior surface opposite the interior surface, the exterior surface and the interior surface joined by a lip surface at either end of the cylindrical body defining two opposing lips extending inwardly from the cylindrical body towards the axis of the cylindrical body until terminating at the lip surface;

a plurality of massage projections extending outwardly from the exterior surface of the cylindrical body, each massage projection of the plurality of massage projections comprising a radiused peripheral edge extending around a base of the massage projection and separated from the base of an adjacent massage projection of the plurality of massage projections by an intermediate space that exposes a portion of the cylindrical body, the plurality of massage projections formed as a plurality of axially-spaced apart bands of the plurality of massage projections, each band of the plurality of bands comprising two or more massage projections of the plurality of massage projections aligned circumferentially about the cylindrical body; and a solid, non-hollow cylindrical core that fills the hollow space within the cylindrical body, the cylindrical core formed of ethylene-vinyl acetate, positioned within the cylindrical body, and engaged between the two opposing lips.

2. The massage roller of claim 1, wherein each massage projection of the plurality of massage projections further comprises an arcuate apex opposite the base, and two opposing side walls sloping closer together from the base toward the arcuate apex.

3. The massage roller of claim 2, wherein each massage projection of the plurality of massage projections comprises a height:width ratio ranging from 1:1 to 1:2.5, and a height: axial length ratio ranging from 1:1.5 to 1:3.

4. The massage roller of claim 3, wherein the plurality of bands are staggered such that the massage projections of one band of the plurality of bands are not axially aligned with the massage projections of an adjacent band of the plurality of bands.

5. The massage roller of claim 3, wherein each massage projection of the plurality of massage projections extends ½ inch from the cylindrical body and comprises an axial cross-section which is rectangular, two opposing end walls that narrow from the base to the arcuate apex, a curved transition between each end wall and the arcuate apex, an axial length between ¾ and 1½ inches, and a base width between ½ and 1¼ inches.

6. The massage roller of claim 5, the two opposing side walls slope closer together from the base toward the arcuate apex at a first angle of 15° and the two opposing end walls narrow from the base to the arcuate apex at a second angle of 60°.

7. The massage roller of claim 1, wherein the plurality of massage projections each comprise an elastomeric material comprising a blend of ethylene-vinyl acetate and polyolefin and a having a durometer hardness of 44 Asker C.

8. The massage roller of claim 1, wherein the plurality of massage projections each comprise an elastomeric material comprising a blend of ethylene-vinyl acetate and polyolefin and a having a durometer hardness of between 30 Asker C and 50 Asker C.

9. A massage roller, comprising:

a hollow cylindrical body comprising an axis, a majority of the cylindrical body having a first wall thickness and opposing ends of the cylindrical body having a second wall thickness greater than the first wall thickness to form two opposing lips;

a plurality of massage projections extending from the cylindrical body, each of the plurality of massage projections comprising a base, an arcuate apex opposite the base, and two opposing side walls sloping closer together from the base toward the arcuate apex, wherein a height:width ratio of each massage projection ranges from 1:1 to 1:2.5 and a height:axial length ratio of each massage projection ranges from 1:1.5 to 1:3; and a non-hollow cylindrical core that fills a hollow space within the hollow cylindrical body and is entrapped between the two opposing lips.

10. The massage roller of claim 9, further comprising a plurality of axially-spaced apart bands, each band comprising two or more of the plurality of massage projections aligned circumferentially about the cylindrical body, wherein the base of each massage projection of the plurality of massage projections comprises a radiused peripheral edge extending around the base and is separated from a base of an adjacent massage projection of the plurality of massage projections by an intermediate space that exposes a portion of the cylindrical body.

11. The massage roller of claim 10, wherein the plurality of bands are staggered such that the massage projections of one band of the plurality of bands are not axially aligned with the massage projections of an adjacent band of the plurality of bands.

12. The massage roller of claim 9, wherein each massage projection of the plurality of massage projections extends ½ inch from the cylindrical body and comprises an axial cross-section which is rectangular, two opposing end walls that narrow from the base to the arcuate apex, a curved transition between each end wall and the arcuate apex, an axial length between ¾ and 1½ inches, and a base width between ½ and 1¼ inches.

13. The massage roller of claim 12, wherein the two opposing side walls slope closer together from the base toward the arcuate apex at a first angle of 15° and the two opposing end walls narrow from the base to the arcuate apex at a second angle of 60°.

14. The massage roller of claim 9, wherein the plurality of massage projections each comprise an elastomeric material comprising an ethylene-vinyl acetate and polyolefin blend having a durometer hardness of 44 Asker C.

15. The massage roller of claim 9, wherein the plurality of massage projections each comprise an elastomeric material comprising an ethylene-vinyl acetate and polyolefin blend having a durometer hardness of between 30 Asker C and 50 Asker C.

16. A massage roller, comprising:

a cylindrical and non-hollow high density polyethylene core;

a single hollow cylindrical body comprising an axis, an interior surface facing towards the high density polyethylene core, and an exterior surface opposite the interior surface, a majority of the cylindrical body having a first wall thickness and opposing ends of the cylindrical body having a second wall thickness greater than the first wall thickness to form two opposing lips positioned to entrap the high density polyethylene core within the cylindrical body, each of the two opposing lips comprising a lip surface that faces towards the axis and joins the interior surface and the exterior surface of the cylindrical body, the hollow cylindrical body comprising a plurality of axially spaced-apart bands each comprising a plurality of massage projections aligned circumferentially around and extending from the cylindrical body, each massage projection comprising a base proximate the cylindrical body and separated from a base of an adjacent massage projection by an intermediate space that exposes a portion of the cylindrical body.

17. The massage roller of claim 16, wherein each massage projection of the plurality of massage projections comprises:

an ethylene-vinyl acetate and polyolefin blend having a durometer hardness of 40 to 50 Asker C; and an arcuate apex opposite the base and two opposing side walls sloping closer together from the base toward the arcuate apex, wherein a height:width ratio of each massage projection ranges from 1:1 to 1:2.5 and a height:axial length ratio of each massage projection ranges from 1:1.5 to 1:3.

18. The massage roller of claim 17, wherein each massage projection of the plurality of massage projections extends ½ inch from the cylindrical body and comprises an axial cross-section which is rectangular, two opposing end walls that narrow from the base to the arcuate apex, a curved transition between each end wall and the arcuate apex, an axial length between ¾ and 1½ inches, and a base width between ½ and 1¼ inches.

19. The massage roller of claim 18, wherein the two opposing side walls slope closer together from the base toward the arcuate apex at a first angle of 15° and the two opposing end walls narrow from the base to the arcuate apex at a second angle of 60°.

20. The massage roller of claim 16, wherein the plurality of bands are staggered such that the massage projections of one band of the plurality of bands are not axially aligned with the massage projections of an adjacent band of the plurality of bands.

* * * * *